United States Patent [19]

Alexeev et al.

[11] 4,200,084

[45] Apr. 29, 1980

[54] ROTARY PISTON ENGINE

[76] Inventors: Kirill M. Alexeev; Antonina I. Alexeev, both of 415 E. 52nd St., N.Y. 10022

[21] Appl. No.: 870,010

[22] Filed: Jan. 16, 1978

Related U.S. Application Data

[63] Continuation-in-part of Ser. No. 750,244, Dec. 13, 1976, abandoned.

[51] Int. Cl.[2] ..... F02B 53/00

[52] U.S. Cl. ..... 123/222; 123/228; 418/141; 418/226

[58] Field of Search ..... 123/222, 228; 418/186, 418/226, 227, 228, 141

[56] References Cited

U.S. PATENT DOCUMENTS

| | | | |
|---|---|---|---|
| 1,272,728 | 7/1918 | Tower | 123/222 X |
| 1,629,580 | 5/1927 | Lithander | 123/222 |
| 1,968,729 | 7/1934 | Winsor et al. | 123/222 |
| 2,651,177 | 9/1953 | Pridham | 123/222 |
| 2,827,024 | 3/1958 | Arietti | 123/228 |
| 2,856,120 | 10/1958 | Fawzi | 418/141 |

*Primary Examiner*—Michael Koczo

[57] ABSTRACT

A disc is fixedly secured to a main shaft for rotation therewith between a cover member and a housing. The disc carries four piston lugs equally disposed about its periphery and which extend radially therefrom for rotary passage through an annular action channel formed between the cover and the housing. Three radially extending combustion members are carried by the housing, equally spaced about the axis of rotation of said main shaft and so that a portion of each of said combustion members extends into said annular action channel for successive co-operation with each of said piston lugs. Each combustion member carries a cam follower which extends from its respective combustion chamber into a radial cam track formed in a cam member carried by the main shaft for rotation therewith. The rotary piston engine provides a highly efficient use of fuel with an advantegeous weight to power output ratio.

14 Claims, 17 Drawing Figures

ROTARY PISTON ENGINE

This application is a continuation-in-part application of U.S. Ser. No. 750,244, filed Dec. 13, 1976, now abandoned.

BACKGROUND OF THE INVENTION

1. Field of Application

This invention relates to automotive engines; and more particularly to rotary automotive engines.

BACKGROUND OF THE INVENTION

2. Description of the Prior Art

The development of the modern automotive engine began many years ago. The significant thrust of that development has been towards engines of the conventional piston type. Some early efforts were made to develop engines of the rotary type because of the opinion that such engines utilized fuel more efficiently. However, many such engines did not prove out. Indicative of this early type rotary engine are those shown in U.S. Pat. No. 937,298 granted on Oct. 19, 1909 to A. Finch for Reversible Rotary Gas or Oil Engine; U.S. Pat. No. 1,272,728 granted on July 18, 1918 to W. J. Tower for Rotary Engine, U.S. Pat. No. 1,286,900 granted on Dec. 10, 1918 to A. C. Ashcraft for Rotary Engine; and U.S. Pat. No. 1,319,932 granted on Oct. 28, 1919 to S. B. Stevenson for Rotary Engine—Explosive Type. The engines of these patents are all crude devices quite unacceptable for the type of vehicle in use today.

Considerable efforts have recently been undertaken to provide a more modern rotary engine. This is especially so in view of the urgent necessity for fuel conservation; which dictates the need for more efficient automotive engines now more than ever before. Rotary engines of the type shown in British Pat. No. 838,166 granted on June 22, 1960 for Improvements in or relating to Rotary Internal Combustion Engines; and in British Pat. No. 910,417 granted on Nov. 14, 1962 for Improvements in and relating to Internal Combustion Engines have still failed to cure the inadequacies of the early rotary engines. On the other hand those like that of U.S. Pat. No. 3,852,001 granted to E. T. Miller on Dec. 3, 1974 for Fluid Translator, while possibly suitable for pressurized fluids such as steam, do not appear to be at all suitable for use with combustible fluids such as gasoline or diesel fuel.

SUMMARY OF THE INVENTION

It is therefore an object of this invention to provide a new and improved combustion engine.

It is another object of this invention to provide a new and improved combustion engine of the rotary type.

It is yet another object of this invention to provide a new and improved rotary combustion engine which is highly efficient in its use of fuel and oil.

It is yet still another object of this invention to provide a new and improved rotary combustion engine which is simple to produce, assemble, and balance since no flywheel is required.

It is yet still a further object of this invention to provide a new and improved rotary combustion engine which minimizes impact loads and vibration and operates relatively smoothly.

This invention involves rotary combustion engines; and contemplates utilizing a rotary disc with four radial piston lugs disposed equally thereabout for movement through an annular channel about which is disposed, in equidistant relationship, three combustion members. The shaft upon which the turbo disc is mounted also mounts a cam which co-acts with the combustion members to align a combustion chamber formed therein to either receive fuel as it is being compressed by one of said piston lugs, to have such compressed fuel ignited so as to drive a piston lug, or to permit a piston lug to pass. The rotary disc in its passage, a significant portion of which is under explosive driving force, also aligns with fuel intake ports, and with waste gas discharge ports, to provide for complete cyclic action.

Other objects, features and advantages of the invention in its details of construction and arrangement of parts will be seen from the above, from the following description of the preferred embodiment when considered with the drawing, and from the appended claims.

DESCRIPTION OF THE PREFERRED EMBODIMENT

For convenience the invention will be described as applied to a rotary engine for use with gasoline as a fuel and having a four piston lug rotary disc disposed for coaction with three combustion members all disposed in equidistant relationships about a main shaft; it should be understood, nevertheless, that without departing from the scope of this invention that the engine can be designed to operate on other conventional fuels, that additional rotary-disc/combustion members sets may be disposed on the main shaft, and that the rotary disc may carry additional numbers of piston lugs in equidistant relationship thereabout as long as additional combustion members are also provided.

Figures 1, 2, 3, 4, 9:
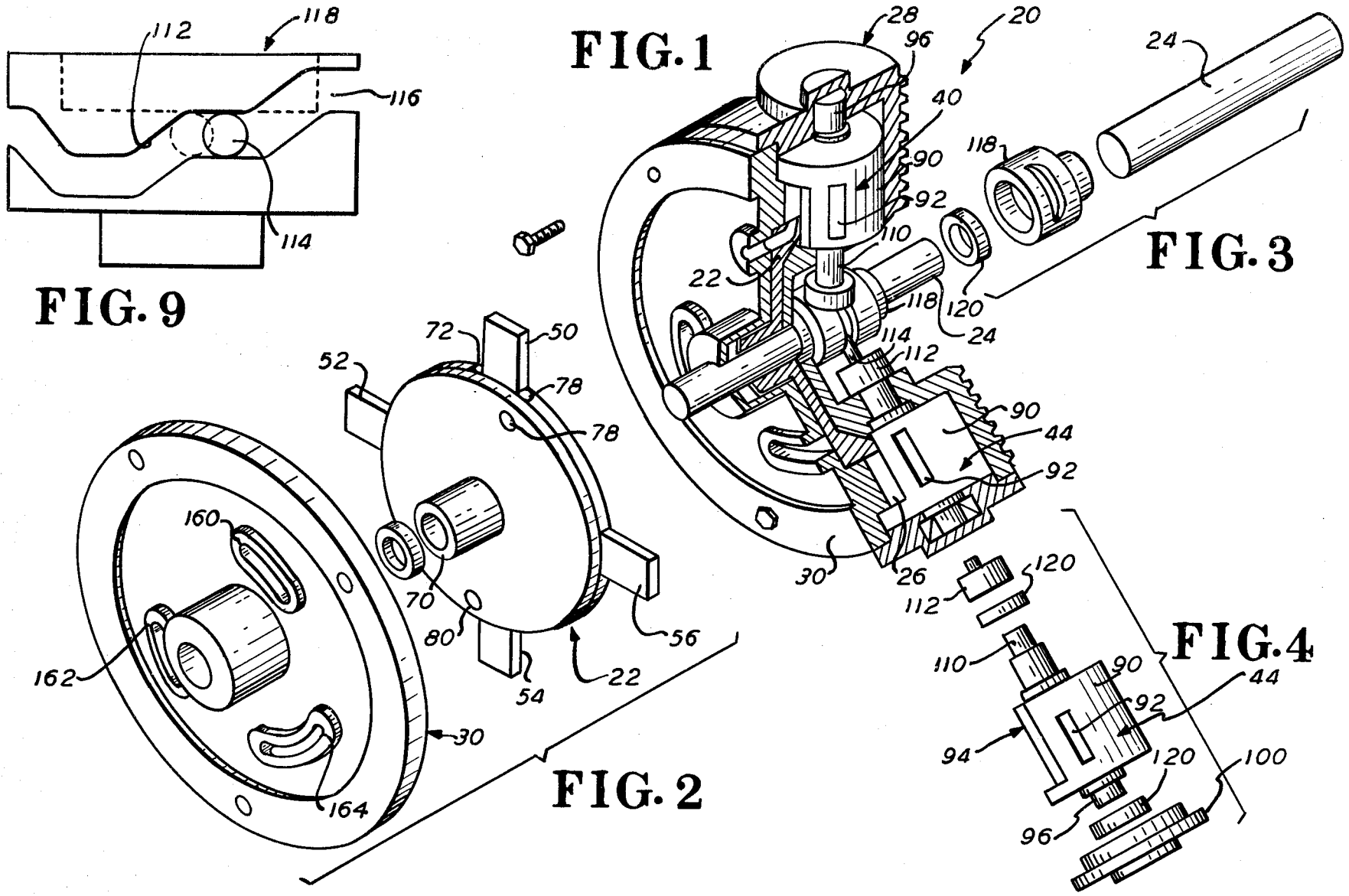
FIG. 1 is a perspective showing of a rotary combustion engine incorporating the instant invention and cut away in part to better show details thereof.
FIG. 2 is an exploded perspective view of the cover and rotary disc of FIG. 1.
FIG. 3 is an exploded perspective view of the main shaft and cam of FIG. 1.
FIG. 4 is an exploded view of one of the combustion members of FIG. 1.
FIG. 9 is an enlarged elevational view of the cam of FIG. 1.
Figure 5:
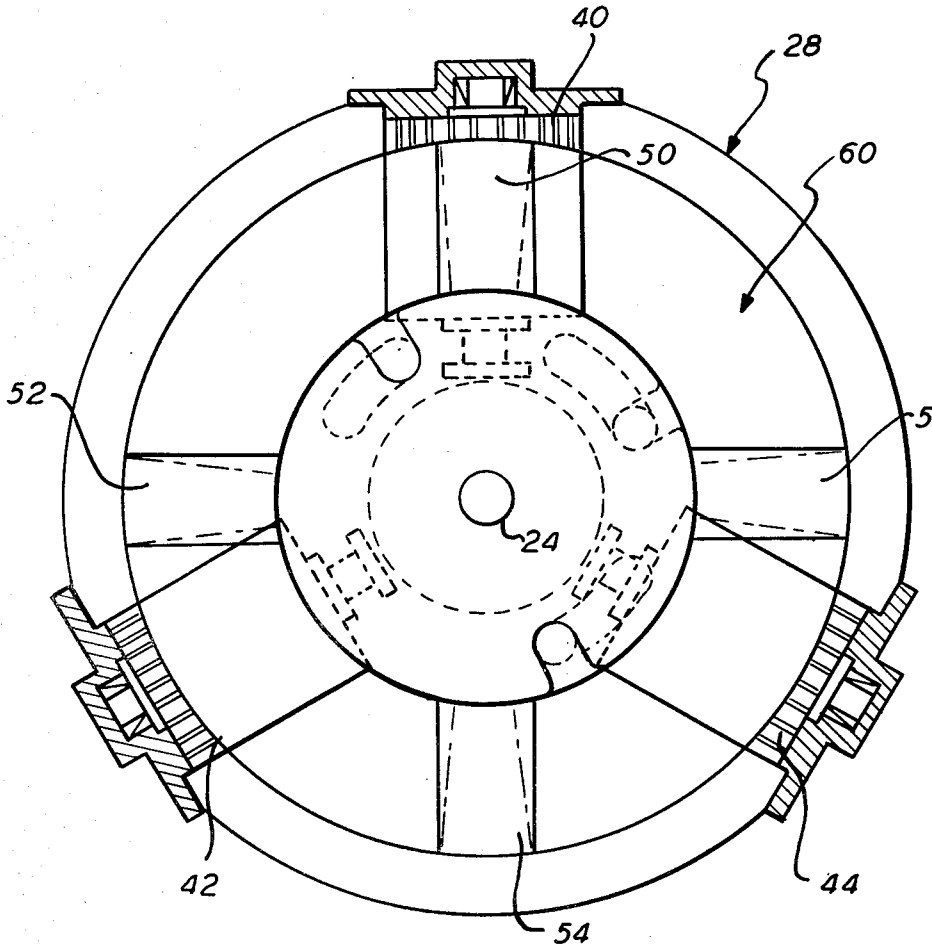
FIG. 5 is an elevational view of the engine of FIG. 1 cut away in part to better show details thereof.

With reference to FIG. 1 there is shown at 20 a rotary combustion engine with a rotary disc 22 (FIGS. 1 and 2) fixedly secured to a main shaft 24 (FIGS. 1 and 3) for rotation therewith in a space 26 provided between a housing 28 (FIGS. 1 and 6) and a cover 30. Three combustion members 40, (FIGS. 1, 5 and 6) 42 and 44 are carried by housing 28 in circumferentially equidistant relationship with respect to each other about main shaft 24; and for successive co-operation with four radially extending piston lugs 50, 52, 54 and 56 disposed in circumferentially equidistant relationship about rotary disc 22. Piston lugs 50–56 are disposed to rotate through an annular channel 60 formed between the outer periphery 62 of the central circumferential portion of rotary disc 22, the inner wall 64 of cover 30 and the inner wall 66 of housing 28. A hub 70 is disposed on rotary disc 22 to facilitate its disposition on main shaft 24.

Figure 7:
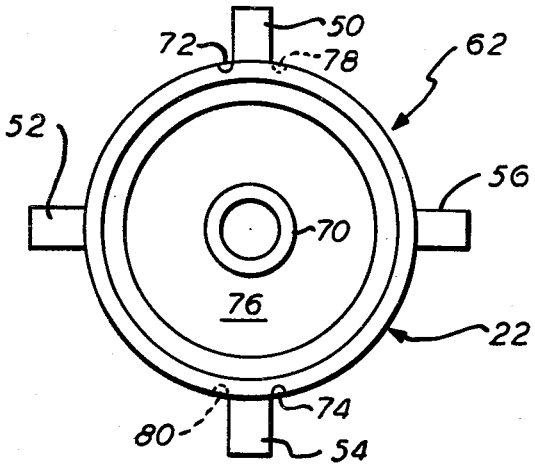
FIG. 7 is an elevational view of the turbo disc.
Figure 8:
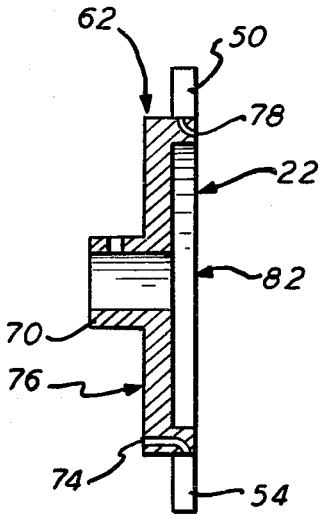
FIG. 8 is a vertical sectional view of the turbo disc of FIG. 7.

A pair of fuel entry ports 72, 74 (FIG. 7) extend from outer periphery 62 of disc 22 through a first surface 76 of disc 22; while a pair of waste gas discharge ports 78, 80 extend from outer periphery 62 of disc 22 through a second surface 82 of disc 22. Fuel ports 72, 74 are disposed 180° apart on disc 22; and exhaust ports 78, 80 are also disposed 180° apart on disc 22. Both sets of ports are disposed in proximity to opposed piston lugs 50, 54; with the fuel ports 72, 74 trailing same in the normal direction of rotation for disc 22, and with the exhaust ports 78, 80 leading same in the normal direction of rotation for disc 22.

Each combustion member 40, 42, 44 includes a central part 90 (FIGS. 1, 4 and 6) through which there extends a combustion chamber 92 and across the face of which there is formed a piston lug groove 94. A top pin 96 extends radially out from central part 90 into a seat 98 formed in a cover plate 100 secured to housing 28 by screws 102 or the like. A bottom pin 110 extends radially in from central part 90 for co-action with a cam follower 112 having a radial cam pin 114 seated in a track 116 of a combustion member operating cam 118 fixedly carried by shaft 24 for rotation therewith. A number of bearings 120 are provided for each combustion member to facilitate oscillating motion thereof about an axis of rotation through pins 96, 110. This oscillating action will be explained later on in the description.

Figure 10:
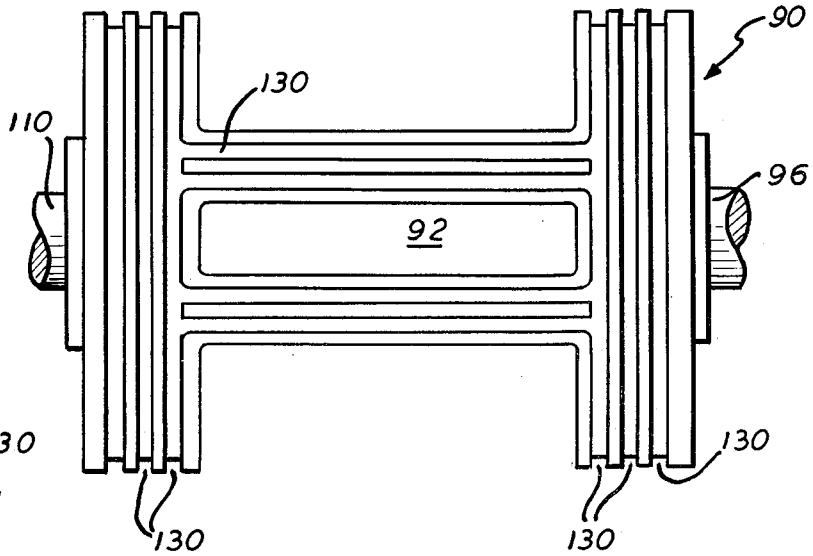
FIG. 10 is an enlarged view of one of the combustion members showing the labyrinth seals therefore.

If desired each combustion member 90 (FIGS. 4, 10 and 11) can have formed and disposed about its periphery a number of labyrinth sealing seats 130 disposed for co-operation with the inner surface 66 of housing 28 to provide an effective seal for combustion member 90 therewithin. In similar manner labyrinth seal seats 132 (FIG. 11) can be formed in the surfaces of rotary disc 22. The wall of housing 28 proximate each combustion member 90 is formed with an aperture 134 extending therethrough, and which is formed to receive a spark plug 136.

Figure 11:
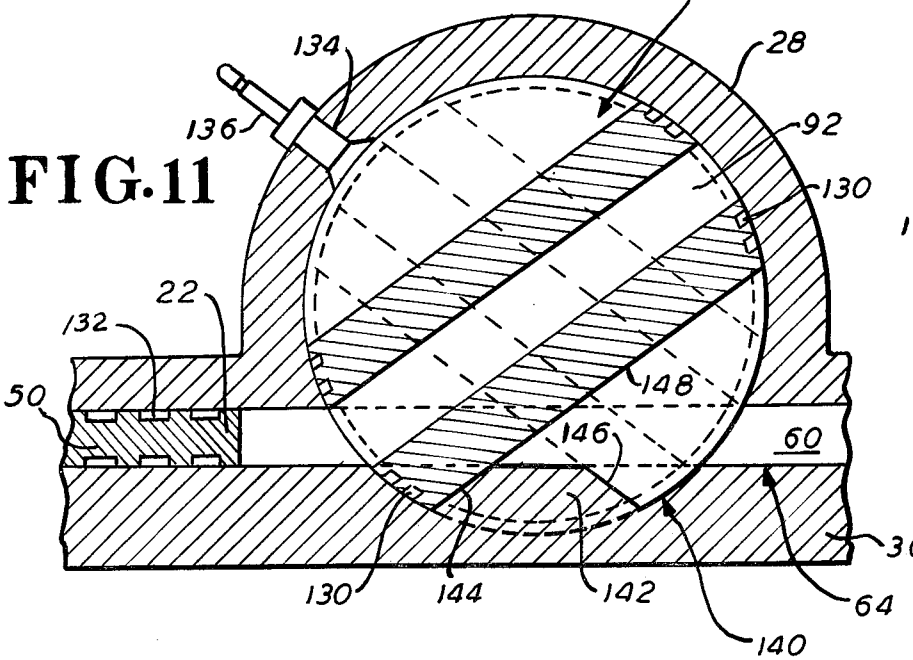
FIG. 11 is an enlarged sectional view of the combustion member of FIG. 10 showing same in position within its housing and disposed for co-action with the rotary disc.

Each combustion member 90 seats mainly in its respective area of housing 28; with a portion of member 90 extending axially therefrom across annular channel 60 and into a seat 140 (FIG. 11) formed in inner wall 64 of cover 30. An abutment 142 having a first abuting surface 144 and a second abuting surface 146 is formed in seat 140 to prevent combustion member 90 from rotating a full 360°; more directly it permits 45° reverse rotation and provides a seal in compression. When wall 148 of piston lug groove 94 of combustion member 90 is in abutting relationship with abutment surface 144 then combustion chamber 92 of member 90 is in communication with annular channel 60 but not aligned with spark plug 136 (as shown in FIG. 11). When wall 148 of groove 94 of member 90 is in abutting relationship with abutment surface 146 (shown in phantom in FIG. 11) then combustion chamber 92 is not only in communication with annular channel 60 but it is also aligned with spark plug 136.

A third position for combustion member 90 is with surface 148 of groove 92 parallel to inner surface 64 of cover 30. In this condition annular channel 60 is fully open in the area of combustion member 90 and a piston lug 50 can pass by.

Figure 12C:
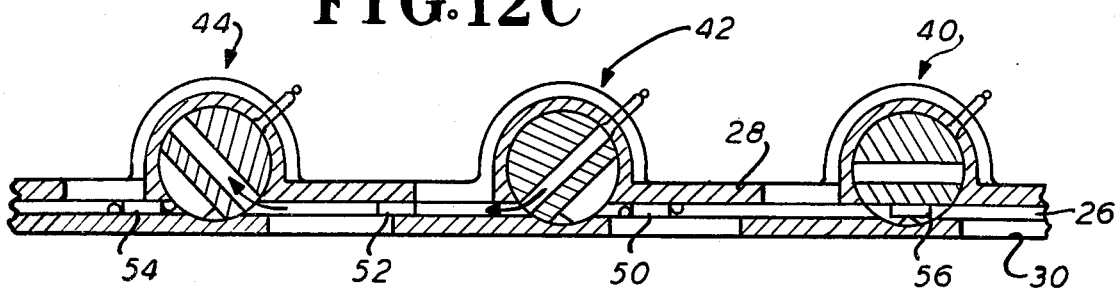
FIGS. 12*a*, 12*b* and 12*c* are schematic showings of the relationship between the three combustion members and the four rotary disc piston lugs at three different times in the engine cycle of operation.
Figure 12B:
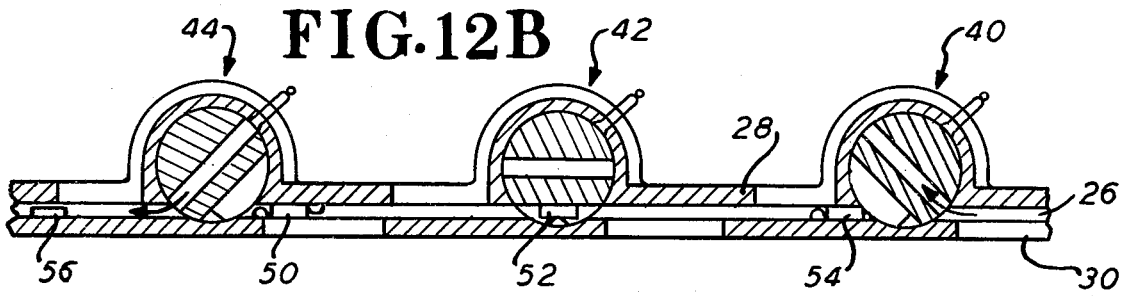

The operation of rotary engine 20 may best be explained with reference to FIGS. 12*a*, 12*b* and 12*c* which show the relative relationships between combustion members 40, 42 and 44 with respect to piston lugs 50, 52, 54 and 56 as rotary disc 22 rotates through a complete revolution. Reference to FIGS. 13*a* and 13*b* may also be helpful since they show the timing relationship between cam track 116, combustion members 40, 42, 44 and piston lugs 50, 52, 54 and 56 during rotation of turbo disc 22 through a complete revolution.

It should be noted that for each combustion member 40 there is a number of dwell or neutral positions "D" (FIG. 13*a*) during which surface 148 of groove 92 is parallel to annular channel 60 (as shown for member 40 of FIG. 13*b*) and a respective piston lug 50, 52, 54, 56 can pass therebetween. There are also two positions for combustion member 40 wherein its combustion chamber 92 is aligned with spark plug 136 and in communication with annular channel 60 (as shown for member 44 in FIG. 13*b*); the first such position is marked "I" for ignition (FIG. 13*b*), and the second such position is marked "F" for fueling. There are two other positions for combustion member 40. In both of these positions its combustion chamber 92 is still in communication with annular channel 60 but not aligned with a spark plug 136 (as shown for number 42 in FIG. 13*b*); with the first such position marked "E" (FIG. 13*a*) for exhaust, and the second such position marked "C" for compression.

As disc 22 rotates its exhaust ports 78, 80 will be brought into communication with passages 160, 162, 164 formed through cover 30; while its fuel entry ports 72, 74 will be moved into alignment with fuel entry means (not shown) formed through housing 28.

Figure 12A:
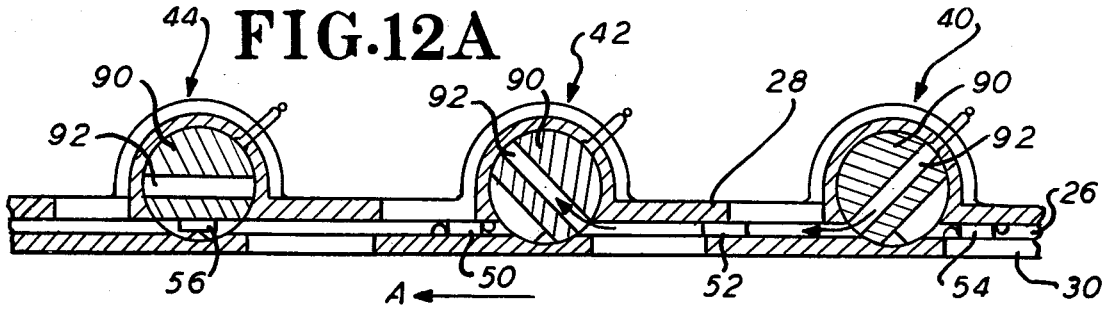
Figure 13B:
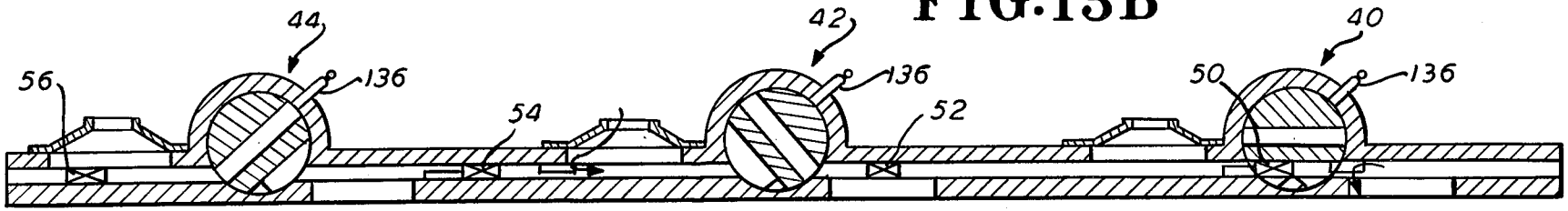
FIGS. 13*a* and 13*b* are schematic showings of the relationship between the three combustion members and the four rotary disc piston lugs in relationship to the profile of the actuating cam of FIG. 9 (FIGS. 13*a* and 13*b* being mirror views as in FIG. 11)
Figure 13A:
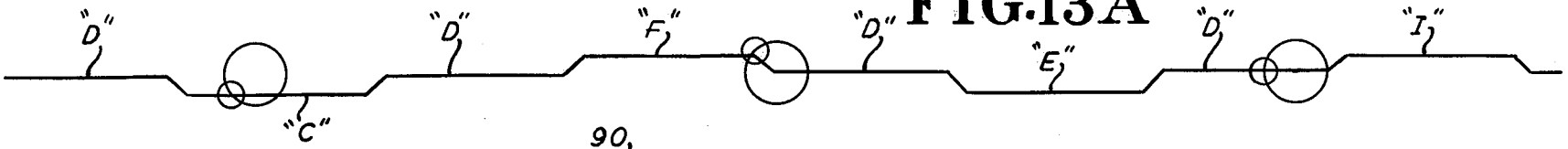

In FIG. 12*a* it can be seen that piston lug 52 is under the explosive action of ignited fuel from combustion member 40 and this drives piston lug 52 and rotary disc 22 in the direction of arrow A (FIG. 12*a*). The leading edge of piston lug 52 is however compressing fuel into the continuous passage formed by annular channel 60 and combustion chamber 92 of member 42. As the cycle continues combustion member 42 will be oscillated through its dwell position to its ignition position and upon spark plug ignition will add further drive to rotary disc 22. This is further continued by ignition from combustion member 44. Thus the cycle continues with fuel entry, compression, ignition and exhaust. The faster fuel is injected the faster the engine will rotate.

Figure 6:
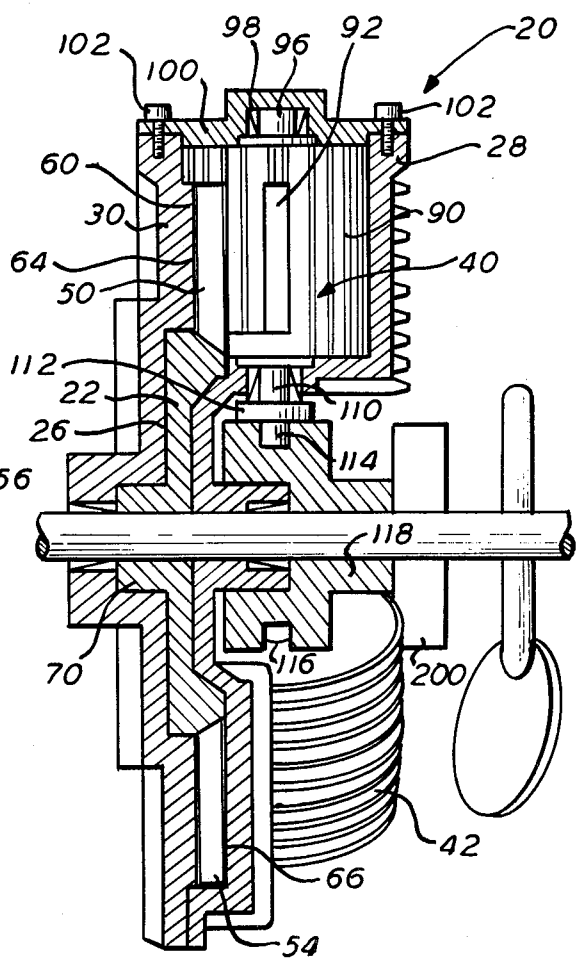
FIG. 6 is a vertical sectional view of the engine of FIGS. 1–5.
Figure 14:
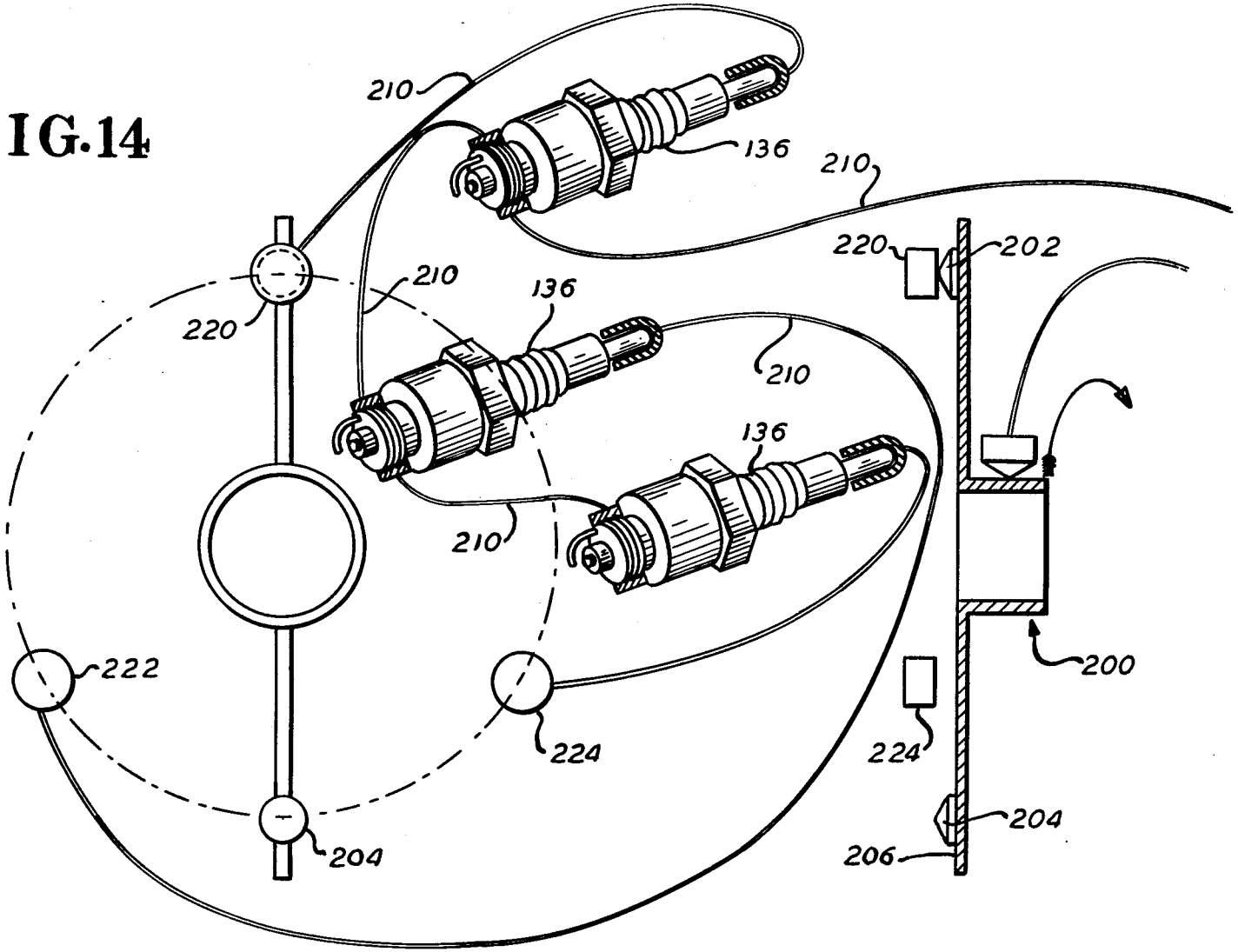
FIG. 14 is a schematic showing of the wiring for the spark plugs and rotor utilized with the engine of FIG. 1.

Also disposed upon main shaft 24 is an electrical distributor 200 (FIGS. 6 and 14). Distributor 200 is connected on one hand to a source of suitable electrical energy (not shown) to actuate spark plugs 136; and includes a pair of electrical contacts 202, 204 suitably and electrically interconnected thereto on a rotor 206, but which are 180° apart. Spark plugs 136 are also interconnected by electrical conductors 210 and that as rotor 206 rotates its contacts 202, 204 successively engage and close circuits with stator contacts 220, 222 and 224 to energize spark plugs 136 and cause ignition of the compressed fuel.

From the above description it will thus be seen that a novel and improved rotary engine has been provided, which rotary engine: utilizes a power stroke that is always tangential to the direction of engine rotation; can be operated effectively and efficiently without either a clutch or transmission since the extent of fuel input determines the power output; and which engine has a very advantageous weight to power output ratio.

It is to be understood that the area encompassed between any combustion chamber and the adjacent piston lugs on both the upstream and downstream side or between adjacent lugs forms an operating chamber undergoing one phase of the internal combustion cycle. Therefore, at any point in time, there are 6 operating chambers in each 360° rotation of the disc for the 4 lug—3 combustion chamber embodiment previously described. Through the cam means operating from the main shaft there is of course synchronized operation of the six operating chambers. In general, where there is one more lug than the number of combustion chambers, there can be as many as twice the number of operating chambers as combustion chambers. In the present case, there are 6 operating chambers for 3 combustion chambers.

The co-operation between the cam followers and cam is such that each combustion member is oscillated between three positions. In a first position a combustion chamber, formed in the combustion member, is aligned to intersect the annular action channel to receive fuel and have same compressed into said combustion chamber by a piston lug moving within said action channel towards said combustion member. In a second position the combustion chamber is oscillated to another position intersecting the action channel but after passage of the piston lug. In this second position the combustion chamber is also aligned with a spark plug and upon actuation thereof the compressed fuel is ignited to provide a propulsion force acting upon said piston lug to impart power thereto in its direction of rotation. In a third position the combustion member is disposed to permit the piston lugs, moving within the annular chamber, to pass the combustion member.

The turbo disc is also formed with a pair of fuel entry ports, disposed proximate diametrically opposed piston lugs; and a pair of exhaust ports, also disposed proximate the same diametrically opposed piston lugs. A system of labyrinth seals is used between the moving and stationary parts; while a simple but efficient electrical distributor provides the spark distribution and timing to effect successive ignition of the compressed fuel.

It is to be also understood that while the present embodiment discloses one engine to one drive shaft, several such engines may be mounted to the same drive shaft in spaced parallel relationship, so as to effect a multiplication of the output power with a single engine design in multiple mountings.

Other modifications to the invention are within the contemplation of this invention as to provide a variable sized combustion chamber by means of a piston within the combustion chamber itself and to coordinate this variable chamber size to the fuel-air intake to the chamber.

It is understood that although we have shown the preferred form of our invention and that various other modifications may be made in the details thereof without departing from the scope as comprehended by the following claims.

We claim:

1. A rotary combustion engine comprising:

(a) disc means, a main shaft carrying said disc means, means to permit rotation of said disc means and shaft including:

(b) cover means and housing means being disposed with said disc means therebetween;

(c) a plurality of piston lugs extending radially from said disc means into an annular channel formed between said cover means and said housing means; and (d) a plurality of combustion means, each disposed between said housing means and said cover means for co-action with each of said piston lugs;

(e) each said combustion means including combustion chamber means and a spark plug, means to move said combustion chamber means between a first position in communication with said annular channel and in alignment with said spark plug carried by said housing means for combustion, and a second position in communication with said annular channel but not aligned with said spark plug, said combustion chamber means being movable in operable association with the disc means but without contact therewith in said first position.

2. The rotary engine of claim 1 wherein said plurality of piston lugs exceeds by one said plurality of combustion means.

3. The rotary engine of claim 2 wherein there are four piston lugs and three combustion means.

4. The rotary engine of claim 1 wherein said means to move said combustion chamber means includes cam means carried by said main shaft for co-action with said combustion means to move same between said first position and said second position.

5. The rotary engine of claim 4 wherein said cam means includes a radially disposed cam track and each said combustion means includes a radially extending cam follower.

6. The rotary engine of claim 1 wherein said disc means carries a pair of fuel entry ports and a pair of waste gas discharge ports.

7. The rotary engine of claim 6 wherein said pair of fuel entry ports are disposed 180° apart on said turbo disc means; and said waste gas discharge ports are disposed 180° apart on said turbo disc means.

8. The rotary engine of claim 7 wherein one of said fuel entry ports is disposed to one side of a particular one of said piston lugs and wherein one of said waste gas discharge ports is disposed to the other side of said one of said piston lugs.

9. The rotary engine of claim 8 wherein said fuel entry ports trail said piston lugs in a normal direction of movement thereof and said waste gas discharge ports lead said piston lugs in said normal direction of movement thereof.

10. The rotary engine of claim 1, including a plurality of labyrinth seals disposed between said combustion means and the adjacent areas of said housing means and said cover means, including labyrinth seals radially disposed on said lugs.

11. The rotary combustion engine of claim 1, wherein the first and second positions, said channel between the